US008657574B2

(12) United States Patent
Amaral et al.

(10) Patent No.: US 8,657,574 B2
(45) Date of Patent: Feb. 25, 2014

(54) SYSTEM AND METHOD FOR COOLING A TURBINE BUCKET

(75) Inventors: Sergio Daniel Marques Amaral, Simpsonville, SC (US); Gary Michael Itzel, Simpsonville, SC (US); Xiuzhang James Zhang, Simpsonville, SC (US); Camilo Andres Sampayo, Greer, SC (US)

(73) Assignee: General Electric Company, Schenectady, NY (US)

( * ) Notice: Subject to any disclaimer, the term of this patent is extended or adjusted under 35 U.S.C. 154(b) by 679 days.

(21) Appl. No.: 12/939,576

(22) Filed: Nov. 4, 2010

(65) Prior Publication Data

US 2012/0114480 A1 May 10, 2012

(51) Int. Cl.
*F01D 5/18* (2006.01)

(52) U.S. Cl.
USPC ..... 416/1; 416/95; 416/96 R; 416/190; 416/193 A; 416/248

(58) Field of Classification Search
USPC ..... 415/1, 115, 135–136, 138–139; 416/1, 416/95, 96 R, 96 A, 97 R, 190, 191, 193 A, 416/248
See application file for complete search history.

(56) References Cited

U.S. PATENT DOCUMENTS

| | | | | |
|---|---|---|---|---|
| 2,603,453 | A * | 7/1952 | Sollinger | 416/97 R |
| 2,912,223 | A * | 11/1959 | Hull, Jr. | 416/221 |
| 4,898,514 | A * | 2/1990 | McCracken | 416/95 |
| 6,478,540 | B2 * | 11/2002 | Abuaf et al. | 416/1 |
| 7,090,466 | B2 | 8/2006 | Honkomp et al. | |
| 7,413,406 | B2 * | 8/2008 | Pietraszkiewicz et al. | 416/96 R |

* cited by examiner

*Primary Examiner* — Christopher Verdier
(74) *Attorney, Agent, or Firm* — Dority & Manning, PA

(57) ABSTRACT

A turbine bucket includes an airfoil, a platform adjacent to the airfoil, and a shank adjacent to the platform. The shank defines a shank cavity, and a divider in the shank cavity creates a pressure differential across the shank cavity. A method for cooling a turbine bucket includes directing a fluid to a forward shank cavity and creating a pressure differential between the forward shank cavity and an aft shank cavity.

16 Claims, 5 Drawing Sheets

SYSTEM AND METHOD FOR COOLING A TURBINE BUCKET

FIELD OF THE INVENTION

The present invention generally involves a system and method for cooling a turbine bucket. In particular, embodiments of the present invention may control and/or direct the flow of cooling fluid to a shank cavity and/or platform of the turbine bucket.

BACKGROUND OF THE INVENTION

Turbines are known in the art for producing energy. A typical turbine includes alternating stages of stationary vanes or nozzles and rotating blades or buckets. The rotating buckets are attached to a rotor. A working fluid, such as steam or combustion gases, flows along a hot gas path across the stationary vanes and rotating buckets. The stationary vanes direct the working fluid onto the rotating buckets, causing the rotating buckets, and thus the rotor, to rotate to produce work. For example, the rotor may be connected to a generator so that rotation of the rotor produces electrical energy. Increasing the temperature of the working fluid generally increases the thermodynamic efficiency of the turbine; however, the increased temperature of the working fluid may also result in excessive heating of the turbine buckets and other components along the hot gas path. Therefore, various systems and methods are known in the art for providing cooling to the turbine buckets to prevent damage and/or increase the operating life of the turbine buckets.

The rotating buckets generally comprise an airfoil that extends from a platform into the hot gas path. The rotating buckets further include a shank radially inward of the platform, and the shank often includes a shank cavity. One system and method known in the art for cooling turbine buckets flows a cooling medium into the shank cavity to cool the shank. The cooling medium may comprise any fluid capable of removing heat from the shank cavity, such as diverted air from a compressor. The pressure of the cooling medium flowing into the shank cavity is generally maintained greater than the pressure of the working fluid flowing over the airfoil in the hot gas path. In this manner, the cooling medium prevents the working fluid from bypassing the airfoil and leaking or being ingested into the shank cavity.

The pressure difference between the cooling medium and the working fluid may result in a first portion of the cooling medium leaking out of the shank cavity and into the hot gas path. The first portion of the cooling medium that leaks into the hot gas path then passes through the alternating stages of stationary vanes and rotating buckets to produce work. However, the pressure difference between the cooling medium and the working fluid may also cause a second portion of the cooling medium to flow downstream in the shank cavity and leak out of the shank cavity into a downstream component, such as a wheel space purge cavity downstream of the shank. The second portion of the cooling medium that leaks out of the shank cavity into the downstream component produces no work in the turbine and therefore does not contribute to the thermodynamic efficiency of the turbine.

An aft seal pin may be installed in the aft portion of the shank cavity to reduce the amount of cooling medium that leaks out of the shank cavity into the downstream component. However, the pressure of the cooling medium may still result in unwanted leakage of the cooling medium past the aft seal pin and out of the shank cavity. Therefore, an improved system and method for cooling turbine buckets that reduces the amount of unwanted leakage of the cooling medium out of the shank cavity would be useful.

BRIEF DESCRIPTION OF THE INVENTION

Aspects and advantages of the invention are set forth below in the following description, or may be obvious from the description, or may be learned through practice of the invention.

One embodiment of the present invention is a turbine bucket that includes an airfoil, a platform adjacent to the airfoil, and a shank adjacent to the platform. The shank defines a shank cavity, and a divider in the shank cavity creates a pressure differential across the shank cavity.

Another embodiment of the present invention is a turbine bucket that includes an airfoil, a platform adjacent to the airfoil, and a shank adjacent to the platform. The shank defines a forward shank cavity and an aft shank cavity with a pressure differential between the forward shank cavity and the aft shank cavity.

The present invention also include a method for cooling a turbine bucket. The method includes directing a fluid to a forward shank cavity and creating a pressure differential between the forward shank cavity and an aft shank cavity.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which:

FIG. 1 is a simplified axial cross-section of a turbine bucket stage;

DETAILED DESCRIPTION OF THE INVENTION

Figure 7:
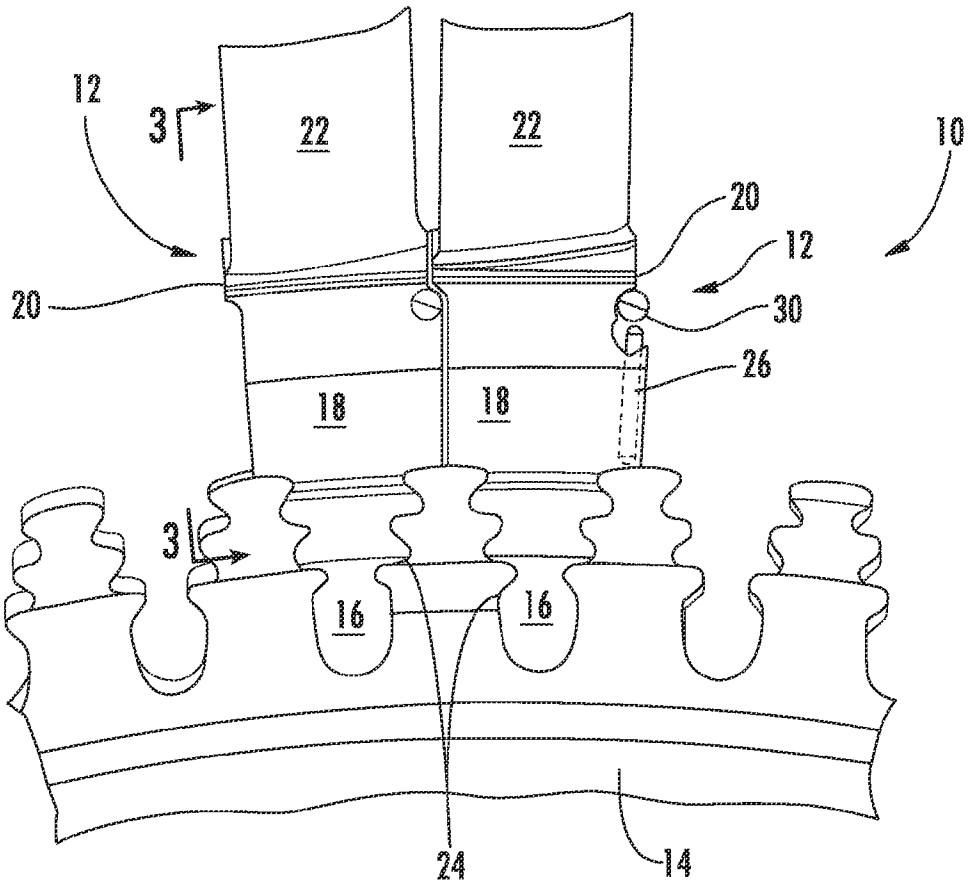

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention provide improved cooling to a shank of a turbine bucket. In addition, particular embodiments of the present invention may also provide improved cooling and/or support to a platform of the turbine bucket. The improved cooling of the shank and/or platform may reduce the cooling demands of the turbine bucket, improve the thermodynamic efficiency of the turbine, and/or extend the operational life of the turbine bucket.

FIG. 1 provides a simplified axial cross-section of a typical turbine bucket stage 10. As shown, the turbine bucket stage 10 generally includes a plurality of turbine buckets 12 attached to a wheel 14 which in turn is attached to a rotor (not shown). Each turbine bucket 12 generally includes a dovetail 16, a shank 18, a platform 20, and an airfoil 22. The dovetail 16 and wheel 14 include complementary surfaces 24 that allow each turbine bucket 12 to slide axially into the wheel 14, and the complementary surfaces 24 between the wheel 14 and the dovetail 16 hold each turbine bucket 12 in place as the turbine bucket stage 10 rotates during operation. The shank 18 connects to the dovetail 16 and extends radially outward from the dovetail 16 to the platform 20. As shown in FIG. 1, the shank 18 may include a plurality of pins that fill gaps between adjacent turbine buckets 12. Specifically, each shank 18 may include a front pin 26 near the front of the shank 18, an aft pin 28 near the rear of the shank 18 (not visible in FIG. 1), and a horizontal pin 30 near the top of the shank 18. As the turbine buckets 12 rotate about the rotor, centrifugal force seats the pins 26, 28, 30 in the gaps between adjacent turbine buckets 12 to reduce vibration and/or fluid flow between adjacent turbine buckets 12. The platform 20 is radially outward of and adjacent to the shank 18, and the airfoil 22 is adjacent to and extends radially outward from the platform 20. A working fluid flows along a hot gas path across the airfoil 22 to cause the turbine bucket stage 10 to rotate about the rotor, as is known in the art.

Figure 2:
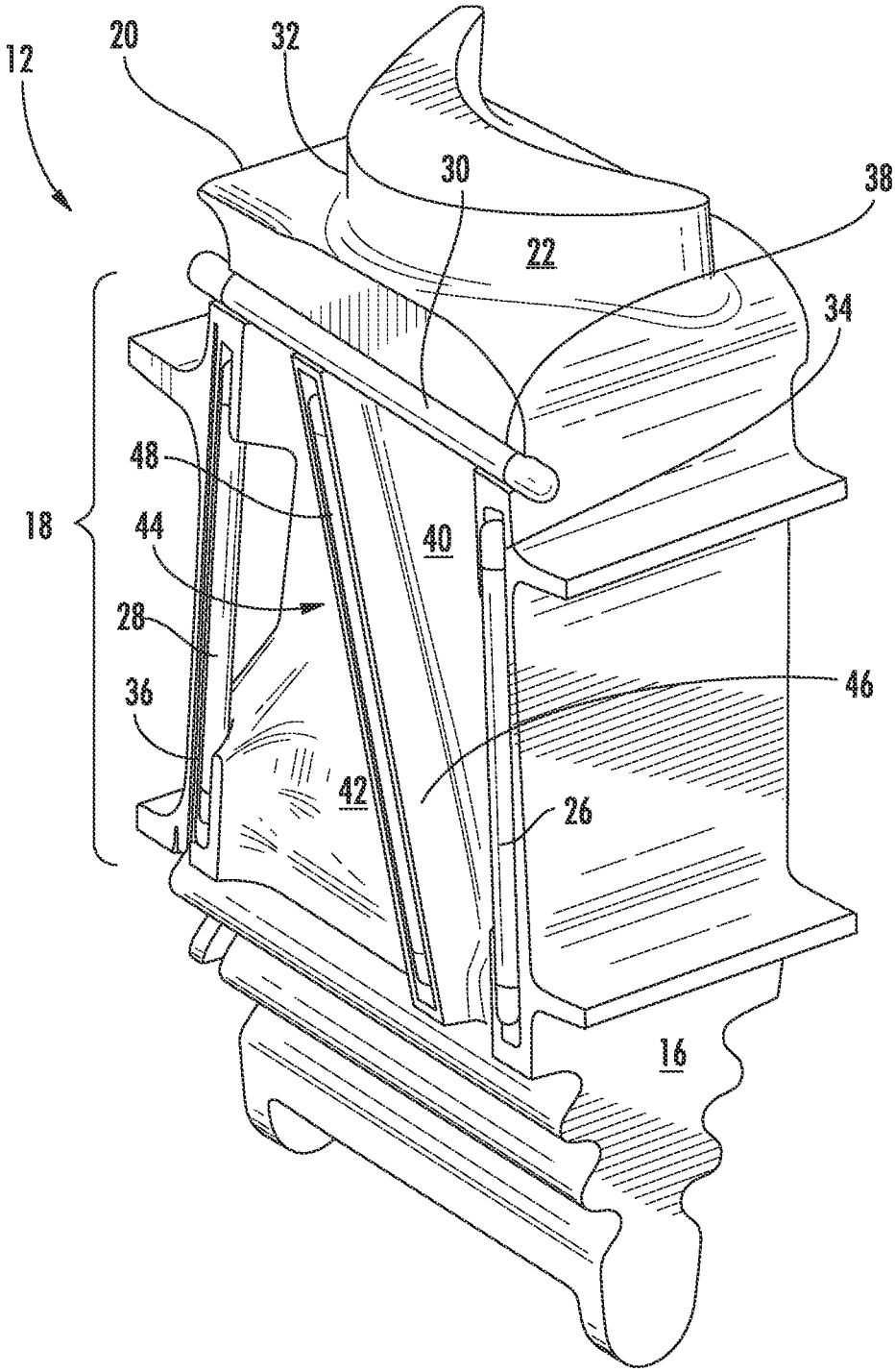
FIG. 2 is a perspective view of a turbine bucket according to one embodiment of the present invention.
Figure 3:
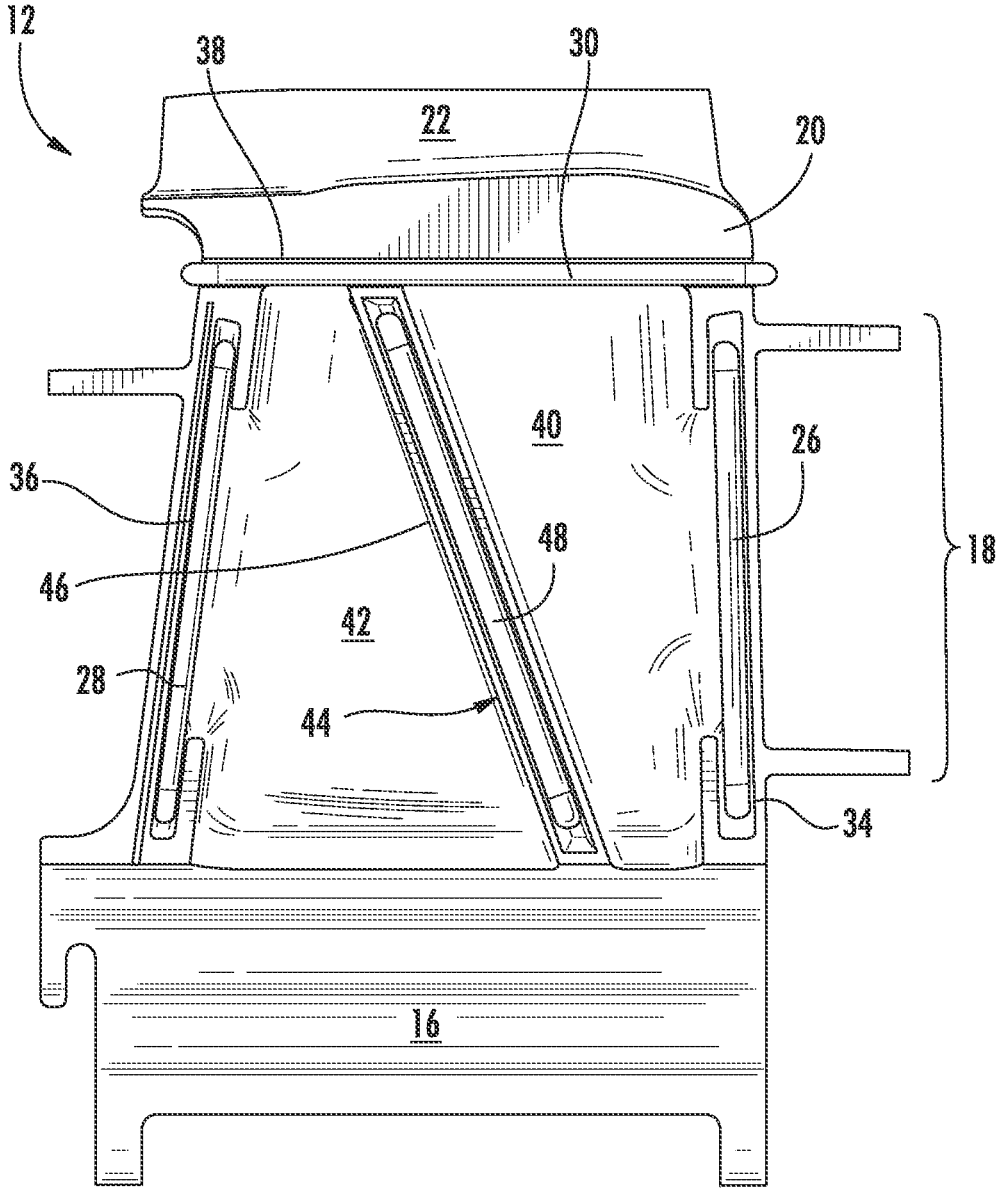
FIG. 3 is a plan view of the vacuum side of the turbine bucket shown in FIG. 2.

FIG. 2 provides a perspective view of the turbine bucket 12 according to one embodiment of the present invention, and FIG. 3 provides a plan view of a vacuum side 32 of the turbine bucket 12 shown in FIG. 2. One of ordinary skill in the art will recognize that the pressure side of the turbine bucket 12 will generally be a mirror image of the vacuum side 32 to allow adjacent turbine buckets 12 to fit together, and illustration of the pressure side of the turbine bucket 12 is not necessary to understand or enable the embodiment of the turbine bucket 12 shown in FIGS. 2 and 3. The turbine bucket 12 generally includes the dovetail 16, shank 18, platform 20, and airfoil 22 as previously described with respect FIG. 1. As shown most clearly in FIG. 2, the shank 18 may include a front trench 34, an aft trench 36, and a horizontal trench 38 for holding the front pin 26, aft pin 28, and horizontal pin 30, respectively. As previously discussed, centrifugal force generated by rotation of the turbine bucket 12 seats the pins 26, 28, 30 in the gaps between an adjacent turbine bucket 12 to reduce vibration and/or fluid flow between adjacent turbine buckets 12.

As shown in FIGS. 2 and 3, the shank 18 may define a forward shank cavity 40 and an aft shank cavity 42, and a divider 44 may be disposed between the forward shank cavity 40 and the aft shank cavity 42. The divider 44 may be disposed at an acute angle to the platform 20 and may be connected through the horizontal pin 30 to the platform 20 to provide additional support to the platform 20. The divider 44 may comprise any suitable structure known in the art for separating or segregating areas or volumes. For example, the divider 44 may comprise a labyrinth seal, gasket, barrier, plate, wiper, or equivalent structures. As shown in FIGS. 2 and 3, the divider 44 may comprise a pocket 46 for holding a seal pin 48. As the turbine bucket 12 rotates, centrifugal force causes the seal pin 48 to move radially outward against the angled pocket 46 to form a partial or complete seal between the forward shank cavity 40 and the aft shank cavity 42. One of ordinary skill in the art will readily appreciate that reducing the angle between the divider 44 and the platform 20 will enhance the seal formed between the seal pin 48 and the pocket 46 as the turbine bucket 12 rotates and the seal pin 48 moves radially outward.

A cooling medium may be provided to the forward shank cavity 40 to cool the shank 18 of the turbine bucket 12. The cooling medium may comprise any fluid capable of removing heat from the shank 18, such as diverted air from a compressor. The cooling medium is generally maintained at a pressure greater than the pressure of the working fluid in the hot gas path. As a result, the cooling medium prevents the working fluid from entering the forward shank cavity 40, and any cooling medium that leaks from the forward shank cavity 40 into the hot gas path joins the working fluid in the hot gas path as it flows over the turbine buckets 12 to produce work. In addition, the divider 44 prevents the cooling medium from freely flowing to the aft shank cavity 42, creating or resulting in a pressure differential between the forward shank cavity 40 and the aft shank cavity 42. The pressure differential between the forward shank cavity 40 and the aft shank cavity 42 results in a reduced pressure of the cooling medium in the aft shank cavity 42. The reduced pressure of the cooling medium in the aft shank cavity 42 reduces the amount of the cooling medium that may leak past the aft seal pin 28 and out of the aft shank cavity 42.

Figure 4:
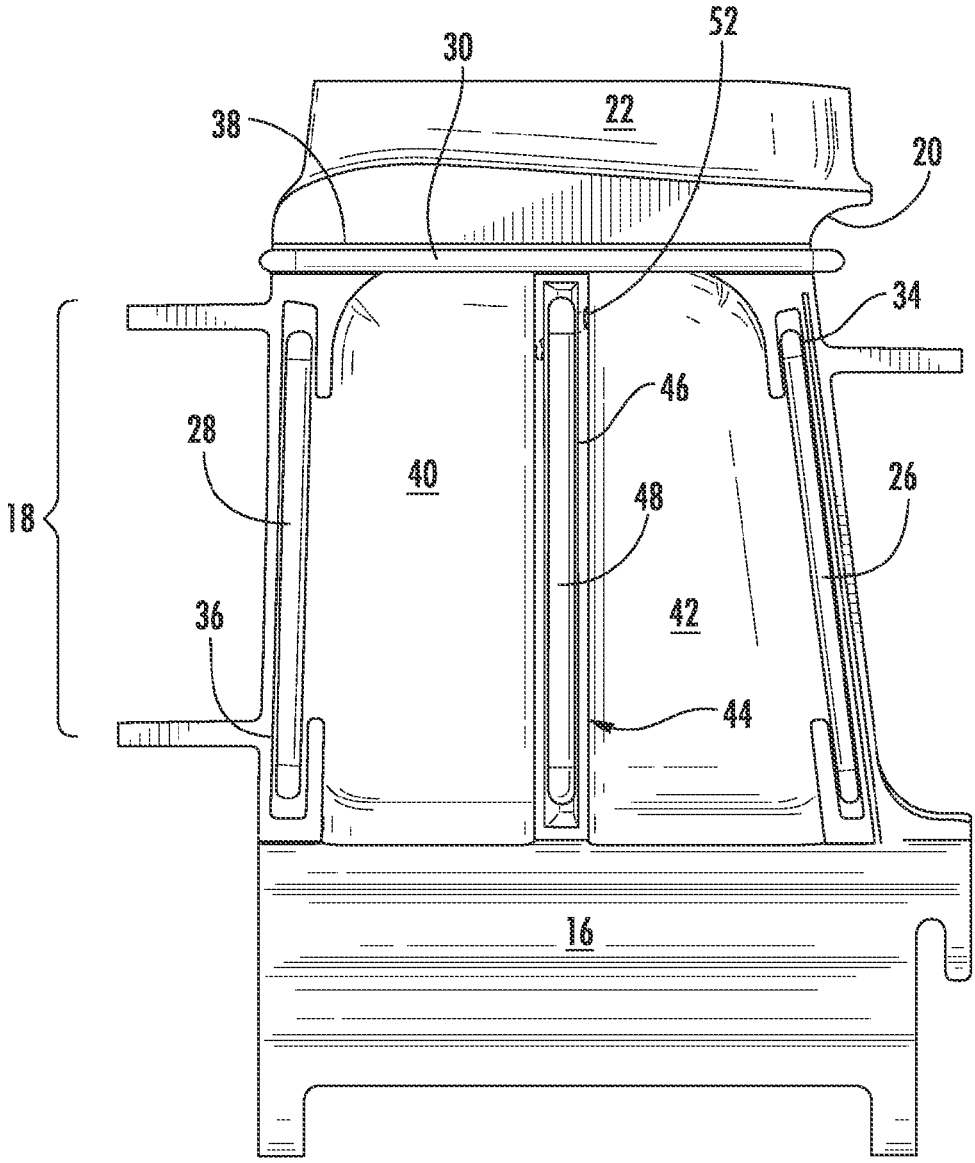
FIG. 4 is a plan view of the pressure side of a turbine bucket according to an alternate embodiment of the present invention.
Figure 5:
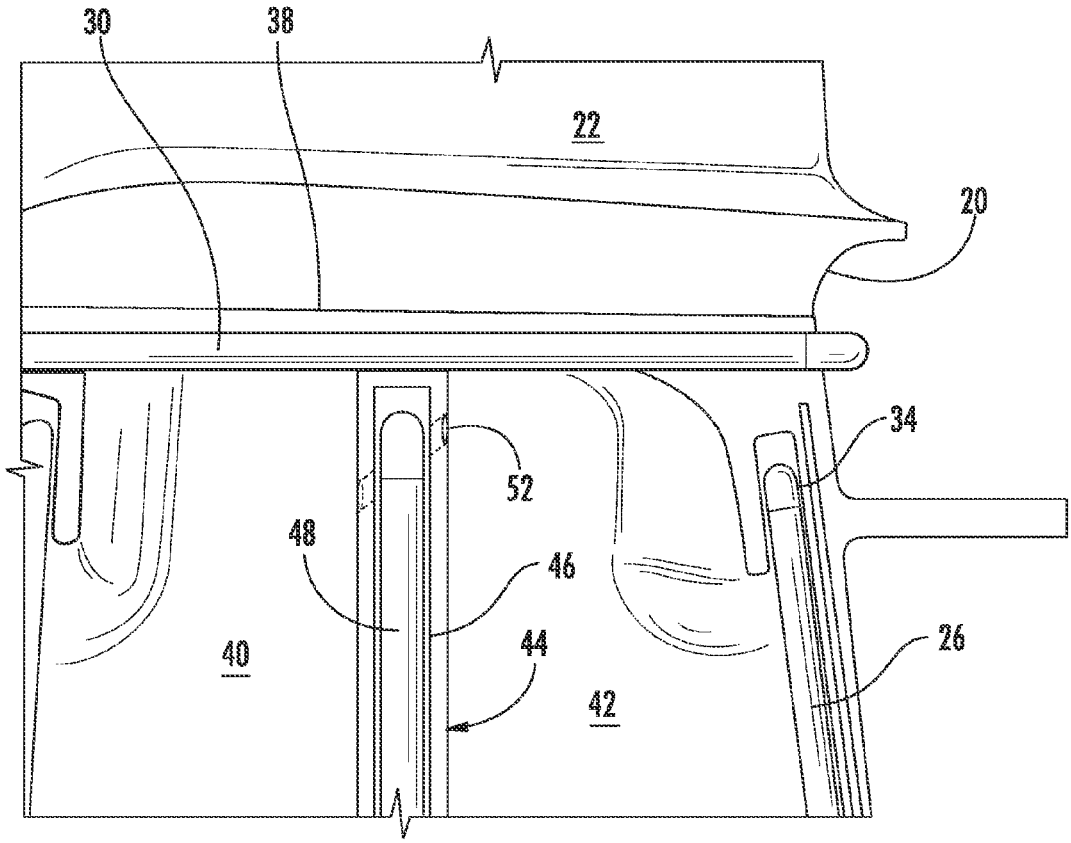
FIG. 5 is a close-up of a portion of the turbine bucket shown in FIG. 4.

FIG. 4 provides a plan view of a pressure side 50 of the turbine bucket 12 according to an alternate embodiment of the present invention, and FIG. 5 provides a close-up of a portion of the pressure side 50 shown in FIG. 4. One of ordinary skill in the art will recognize that the vacuum side of the turbine bucket 12 will generally be a mirror image of the pressure side 32 to allow adjacent turbine buckets 12 to fit together, and illustration of the vacuum side of the turbine bucket 12 is not necessary to understand or enable the embodiment of the turbine bucket 12 shown in FIGS. 4 and 5. The turbine bucket 12 again generally includes the dovetail 16, shank 18, platform 20, and airfoil 22 as previously described with respect FIG. 1. In addition, the shank 18 may again include the front, aft, and horizontal trenches 34, 36, 38 and associated front, aft, and horizontal pins 26, 28, 30 as previously described with respect to FIGS. 1, 2, and 3. Moreover, the shank 18 again defines the forward shank cavity 40 and aft shank cavity 42, and the divider 44 may be disposed between the forward shank cavity 40 and the aft shank cavity 42. The divider 44 may again comprise the pocket 46 for holding the seal pin 48, and the divider 44 may be connected through the horizontal pin 30 to the platform 20 to provide additional support to the platform 20.

In the particular embodiment shown in FIGS. 4 and 5, the divider 44 may be disposed perpendicular to the platform 20 to provide additional support to the platform 20. As shown most clearly in FIG. 5, the divider 44 may further include one or more apertures 52 through the divider 44 to allow a portion of the cooling medium to flow through the divider 44 into the aft shank cavity 42. The aperture 52 may be angled in the divider 44 to direct the cooling medium flowing through the aperture 52 onto the platform 20. In this manner, the cooling medium flowing through the aperture 52 impinges on the platform 20 to provide impingement cooling to the platform 20.

The embodiments of the turbine bucket 12 described and illustrated with respect to FIGS. 2, 3, 4, and 5 thus produce a pressure differential of the cooling medium between the front shank cavity 40 and the aft shank cavity 42. The pressure differential allows the pressure of the cooling medium in the forward shank cavity 40 to be maintained greater than the working fluid in the hot gas path to reduce and/or prevent the ingestion of working fluid into the forward shank cavity 40. In addition, the pressure differential results in a reduced pressure of the cooling medium in the aft shank cavity 42, thereby reducing the amount of cooling medium that leaks past the aft pin 28 and out of the aft shank cavity 42. As a result, the amount of cooling medium that flows through the shank 18 without producing work in the turbine is reduced. One of ordinary skill in the art can readily appreciate that in alternate embodiments the shank 18 may include more than one divider 44 between the front shank cavity 40 and the aft shank cavity 42 to produce multiple pressure differentials between the front shank cavity 40 and the aft shank cavity 42, and illustration of multiple dividers 44 is not necessary to understand or enable alternate embodiments of the turbine bucket 12 within the scope of the present invention.

The embodiments previously described with respect to FIGS. 2, 3, 4, and 5 provide a method for cooling the turbine bucket 12. The method generally includes directing the fluid to the forward shank cavity 40 and creating a pressure differential between the forward shank cavity 40 and the aft shank cavity 42. To create the pressure differential, the method may further include dividing the forward shank cavity 40 from the aft shank cavity 42. As shown particularly in FIGS. 4 and 5, the method may further include allowing a portion of the fluid to flow from the forward shank cavity 40 to the aft shank cavity 42 to impinge on the platform 20 to provide impingement cooling to the platform 20.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A turbine bucket comprising:

an airfoil;

a platform adjacent to the airfoil;

a shank adjacent to the platform, wherein the shank defines a shank cavity;

a divider in the shank cavity, wherein the divider comprises a seal pin and creates a pressure differential across the shank cavity.

2. The turbine bucket as in claim 1, wherein the divider is disposed perpendicular to the platform.

3. The turbine bucket as in claim 1, wherein the divider is disposed at an acute angle to the platform.

4. The turbine bucket as in claim 1, wherein the divider is connected to the platform.

5. The turbine bucket as in claim 1, further comprising a plurality of dividers in the shank cavity, wherein the plurality of dividers create a plurality of pressure differentials across the shank cavity.

6. The turbine bucket as in claim 1, further comprising an aperture through the divider, wherein the aperture allows a fluid to flow through the divider.

7. The turbine bucket as in claim 6, wherein the aperture is angled to impinge the fluid on the platform.

8. A turbine bucket comprising:

an airfoil;

a platform adjacent to the airfoil;

a shank adjacent to the platform, wherein the shank defines a forward shank cavity and an aft shank cavity with a pressure differential between the forward shank cavity and the aft shank cavity;

a divider between the forward shank cavity and the aft shank cavity, wherein the divider comprises a seal pin.

9. The turbine bucket as in claim 8, wherein the divider is disposed perpendicular to the platform.

10. The turbine bucket as in claim 8, wherein the divider is disposed at an acute angle to the platform.

11. The turbine bucket as in claim 8, wherein the divider is connected to the platform.

12. The turbine bucket as in claim 8, further comprising an aperture between the forward shank cavity and the aft shank cavity, wherein the aperture allows a fluid to flow from the forward shank cavity to the aft shank cavity.

13. The turbine bucket as in claim 12, wherein the aperture is angled to impinge the fluid on the platform.

14. A method for cooling a turbine bucket comprising:

directing a fluid to a forward shank cavity;

dividing the forward shank cavity from an aft shank cavity with a divider comprising a seal pin; and creating a pressure differential between the forward shank cavity and the aft shank cavity.

15. The method is in claim 14, further comprising allowing a portion of the fluid to flow from the forward shank cavity to the aft shank cavity.

16. The method as in claim 14, further comprising impinging a portion of the fluid in the aft shank cavity onto a turbine platform.

* * * * *